United States Patent [19]

Winkler

[11] Patent Number: 4,941,655

[45] Date of Patent: Jul. 17, 1990

[54] SKEW-CORRECTING AND DELAY MECHANISM FOR SHEET FEEDER

[75] Inventor: Theodore Winkler, Levittown, Pa.

[73] Assignee: Brandt, Inc., Bensalem, Pa.

[21] Appl. No.: 271,914

[22] Filed: Nov. 15, 1988

[51] Int. Cl.[5] ..... B65H 9/00

[52] U.S. Cl. ..... 271/242; 271/229; 271/266; 271/272

[58] Field of Search ..... 271/119, 121, 242, 229, 271/230, 226, 114, 266, 272, 10

[56] References Cited

U.S. PATENT DOCUMENTS

| | | | |
|---|---|---|---|
| 3,980,295 | 9/1976 | Kleid | 271/272 X |
| 4,420,153 | 12/1983 | Winkler et al. | 271/315 X |
| 4,474,365 | 10/1984 | DiBlasio | 271/3 |
| 4,660,822 | 4/1987 | Winkler et al. | 271/119 X |
| 4,779,861 | 10/1988 | Ozawa et al. | 271/119 |

*Primary Examiner*—Michael S. Huppert
*Assistant Examiner*—David H. Bollinger
*Attorney, Agent, or Firm*—Shenier & O'Connor

[57] ABSTRACT

Skew-correcting apparatus in which first and second sets of opposing feed rollers each comprise a pair of end rollers and a center roller between the end rollers. The first center roller has a sheet-gripping portion of limited circumferential extent forming a nip with the second center roller, while the first pair of end rollers engage the second pair of end rollers. The second set of rollers are coupled for common rotation; the first pair of end rollers are mounted for rotation relative to the first center roller. The first center roller is driven while the remaining rollers are retarded so that the remaining rollers are normally stationary to align the leading edge of a sheet but are driven by the sheet-gripping portion of the first center roller to advance the sheet through the nip. A downstream feed roller driven synchronously with the first center roller and also having a sheet-gripping portion of limited circumferential extent is used to advance a sheet to the opposing sets of feed rollers.

6 Claims, 2 Drawing Sheets

SKEW-CORRECTING AND DELAY MECHANISM FOR SHEET FEEDER

BACKGROUND OF THE INVENTION

This invention relates to apparatus for correcting any skew that may have developed in a sheet being fed along a path and for momentarily stopping the sheet for testing or the like.

There are known in the art numerous machines for feeding documents such as currency from a stack for such operations as batching, counting or the like. Typical machines of this type are shown in DiBlasio U.S. Pat. No. 4,474,365. One problem encountered in such machines of the prior art is that sheets become skewed owing to asymmetries in drive force. Not only do such skewed documents form an untidy stack, but they are much more likely to jam, thereby disrupting the entire counting or batching operation.

Skew-correcting mechanisms are known in the art. One such mechanism is shown in Kleid U.S. Pat. No. 3,980,295. In the apparatus shown in that patent, rollers are continuously operative to advance an arriving sheet. In many applications, however, it is desirable to stop the sheet for testing or some other operation.

SUMMARY OF THE INVENTION

One object of my invention is to provide a sheet feeder which is capable of handling sheets that have become skewed.

Another object of my invention is to provide a sheet feeder which momentarily stops sheets for testing or some other operation.

Other and further objects will be apparent from the following disclosure.

In one aspect, my invention contemplates skew-correcting apparatus in which first and second sets of opposing feed rollers each comprise a pair of end rollers and a center roller between the end rollers. The first center roller has a sheet-gripping portion of limited circumferential extent forming a nip with the second center roller, while the first pair of end rollers engage the second pair of end rollers. The second set of rollers are coupled for common rotation; the first pair of end rollers are mounted for rotation relative to the first center roller. The first center roller is driven while the remaining rollers are retarded so that the remaining rollers are normally stationary to align the leading edge of a sheet but are driven by the sheet-gripping portion of the first center roller to advance the sheet through the nip.

In another aspect, my invention contemplates sheet-feeding apparatus in which a feed roller disposed along a path has a sheet-gripping portion of limited circumferential extent. Suitable means are provided for forming a nip with the sheet-gripping portion of the roller and for retarding the passage of a sheet through the nip in the absence of engagement of the sheet by the sheet-gripping portion. Means are also provided for advancing a sheet toward the nip and for driving the sheet-gripping portion through the nip synchronously with the advance of the sheet so that the sheet is held in the nip for a predermined period before being discharged therefrom. Preferably, the advancing means comprises an upstream feed roller having a sheet-gripping portion of limited circumferential extent which forms a nip and which is driven synchronously with the downstream feed roller.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
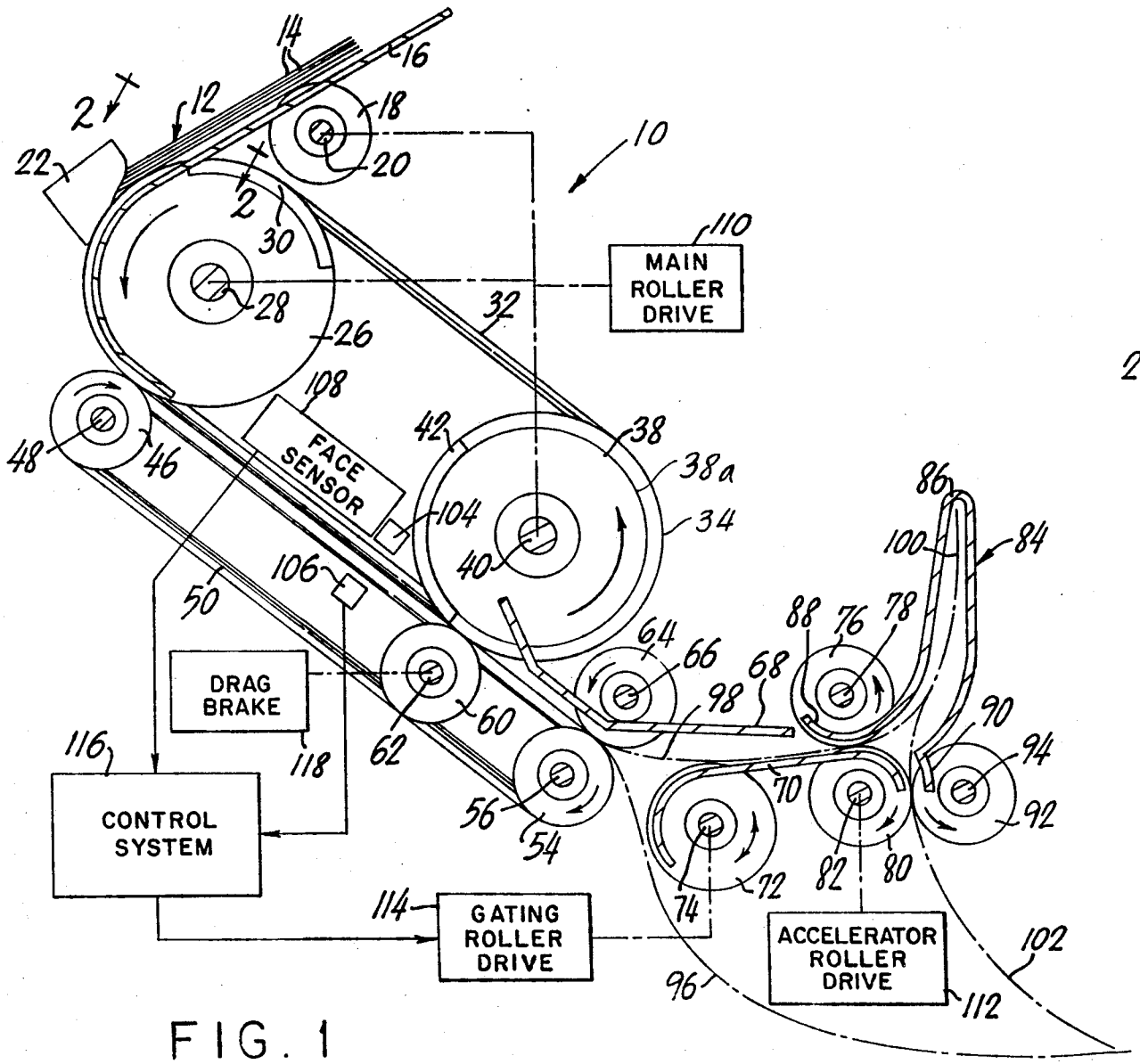
FIG. 1 is a section along line 1—1 of FIG. 3 of a sheet feeder incorporating my skew-correcting and delay mechanism.

Referring now to FIG. 1, a sheet feeder incorporating my skew-correcting and delay mechanism, indicated generally by the reference numeral 10, includes an input tray 16 for supporting a stack 12 of sheets 14, which may be paper currency of a specified denomination. As shown in FIG. 1, tray 16 is upwardly inclined toward the front of the feeder 10 (to the right in FIG. 1) to bias the stack 12 of sheets 14 into the nip formed by respective feed rollers 26 carried by a shaft 28 and stripper members 22 opposite rollers 26. One or more counterclockwise-driven picker rollers 18 mounted eccentrically on a shaft 20 below tray 16 extend upwardly through slots (not shown) in tray 16 during a portion of their rotation to urge the bottom sheet 14 into the feed nip formed by feed rollers 26 and stripper members 22.

Figure 2:
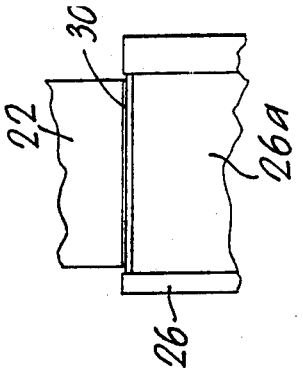
FIG. 2 is an enlarged view along line 2—2 of FIG. 1 of the feed nip of the sheet feeder shown in FIG. 1.
Figure 3:
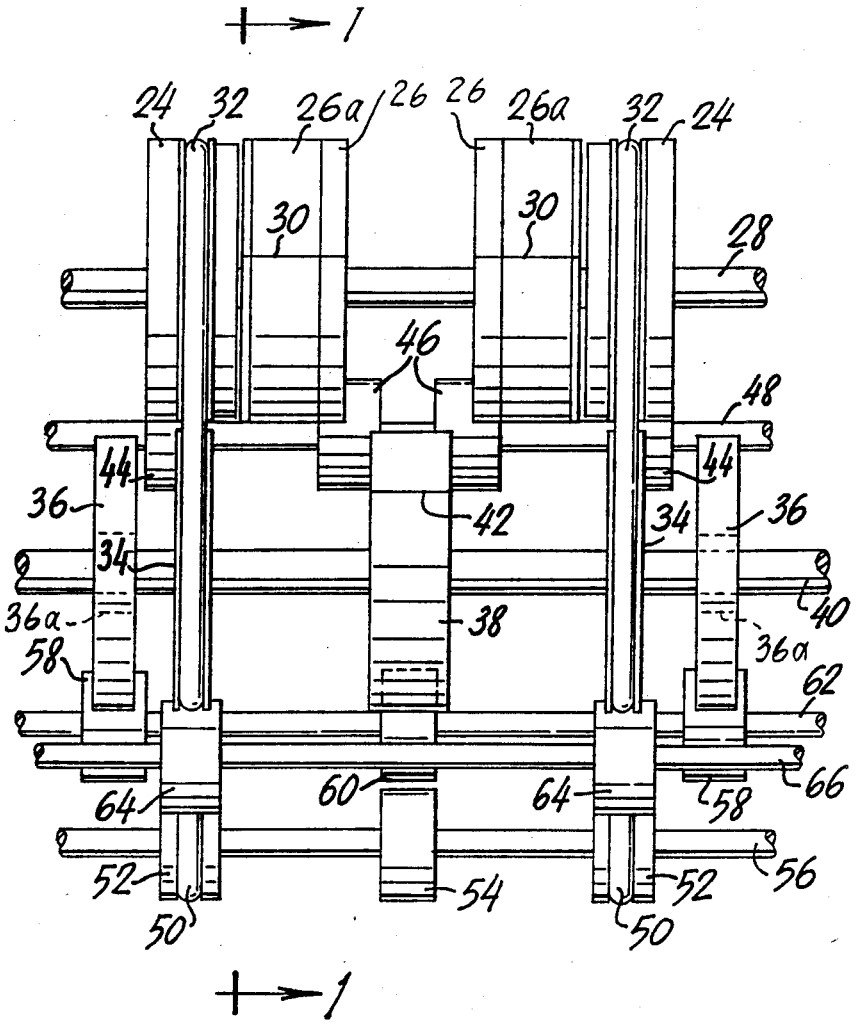
FIG. 3 is a fragmentary front elevation of the sheet feeder shown in FIG. 1, with parts omitted.

Referring now also to FIGS. 2 and 3, each of feed rollers 26 is formed with a slightly smaller-radius central portion **26*a* to form an indentation between the ends of the roller into which the corresponding stripper member 22 extends. Feed rollers 26 are generally formed of a low-friction material (e.g., plastic), but carry respective high-friction (e.g., serrated rubber) inserts 30 that extend over approximately 90° of the rollers' peripheries. As shown in FIG. 2, each of the inserts 30 has a radius slightly greater than that of the remaining portion 26*a* of the roller in order to grip a sheet 14 passing therebetween, the spacing between inserts 30 and strippers 22 being such as to allow the passage of only a single sheet. Roller inserts 30 and stripper members 22 are formed of such materials that the coefficient of friction between a sheet 14 and the stripper member 22 is greater than that between two contacting sheets but less than the coefficient of friction between a sheet and the friction insert 30. Because of this spacing and relationship of frictional coefficients, stripper members 22 are generally effective to prevent the simultaneous feeding of more than a single sheet of paper. At the same time, inserts 30 grip the bottom sheet with sufficient frictional force to overcome the resistive force of stripper members 22**.

The shaft 28 supporting feed rollers 26 is driven by a main roller drive 110, preferably at a speed of 600 rpm in the embodiment shown. Main roller drive 110 also drives picker rollers 18 at a suitable peripheral velocity to advance sheets 14 from the bottom of the stack 12 into the feed nip. Shaft 28 carries a pair of pulleys 24 outboard of feed rollers 26. An O-ring belt 32 couples each pulley 24 to a pulley 34 carried by a shaft 40 downstream of shaft 28. Shaft 40 is also driven directly by the main roller drive 110 synchronously with shaft 28; preferably, each shaft is driven by means of a timing belt or the like (not shown) to maintain the two shafts in synchronism with each other. Shaft 40 carries a pair of end rollers 36 outboard of pulleys 34 as well as a center drive roller 38 between the two pulleys. Respective clutch bearings 36*a* mount end rollers 36 for rotation relative to shaft 40. Center roller 38 is similar in construction to the central portions 26*a* of feed rollers 26 and has a highfriction insert 42 extending over 90° of its periphery. The remaining portion 38*a* of the roller periphery is recessed radially inwardly, as shown in FIG. 1.

After passing through the feed nip formed by feed rollers 26 and stripper members 22, the bottom sheet is directed by suitable guide members (not shown) into the nip formed by respective pulleys 44 opposite pulleys 24 and rollers 46 opposite the inboard rim portions of feed rollers 26. A shaft 48 supports pulleys 44 and rollers 46 for common rotation therewith. Respective O-rings 50 couple pulleys 44 to pulleys 52 carried by a shaft 56 disposed downstream from shaft 40 below the feed path. Shaft 56 also carries a center roller 54. Pulleys 52 oppose respective rollers 64 carried by a shaft 66 above the feed path. A shaft 62 intermediate shafts 48 and 56 supports end rollers 58 opposite rollers 36 and a center roller 60 opposite drive roller 38. Preferably, each of lower rollers 58 and 60 comprises a high-friction material such as rubber.

Figure 4:
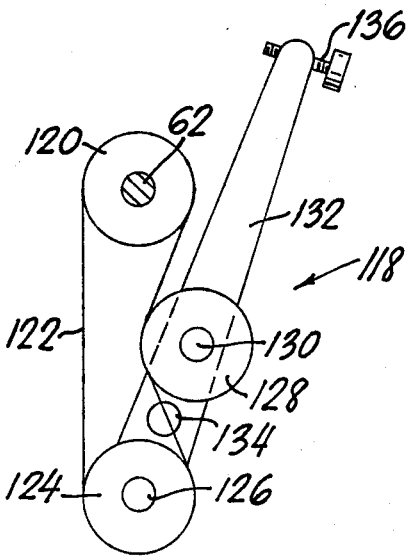
FIG. 4 is a section of the drag brake of the sheet feeder shown in FIG. 1.

Shafts 48, 56 and 66 and the feed members carried by the shafts are driven frictionally through contact with opposing feed members to rotate at the same peripheral velocity as feed rollers 26. The shaft 62 supporting lower rollers 58 and 60, however, is coupled to a drag brake 118 of any suitable type known to the art. For example, referring now to FIG. 4, shaft 62 may carry a timing pulley 120 coupled by a timing belt 122 to a second timing pulley 124 carried on a shaft 126 rotatable about a fixed axis. Timing belt 122 is adjustably tensioned by a third pulley 128, carried on a shaft 130 mounted on an arm 132 rotatable about a pivot 134. An adjustment screw 136 received by the free end of pivot arm 132 engages a fixed stop (not shown) to define the position of shaft 130 and hence the tension in belt 122. The effective drag offered by timing belt 122 may be suitably adjusted by tensioning belt 122 to increase the drag or untensioning the belt to decrease the drag.

Sheets entering the upper nip between rollers 26 and 46 continue to move along with belts 32 and 50 until they reach the nip formed by end rollers 36 and 58. There, lower rollers 58 and 60, which are stationary at this time, exert a braking force on the sheet to halt the sheet momentarily at the entrance to the nip. Upper end rollers 36, which frictionally engage lower end rollers 58 and which are rotatable relative to shaft 40, are also stationary at this time. If the arriving sheet is skewed, it will strike one of the opposing pairs of end rollers 36 and 58 first, rotating the sheet and thereby eliminating the skew. The sheet remains stationary until the friction insert 42 of upper center roller 38 engages the sheet to drive lower center roller 60, and thus end rollers 58 and 36, against the retarding action of drag brake 118. Drive roller 38 draws the sheet 14 through the nip formed by rollers 38 and 60 and advances it into the nip formed by rollers 64 and 52 (FIG. 3). The period during which the sheet is held in the nip is determined by the speed at which rollers 26 and 38 are driven, as well as the angular displacement between inserts 30 and insert 42. In the embodiment shown, the delay is preferably between about 20 and 40 milliseconds.

Upon emerging from the nip formed by rollers 64 and 52, the sheet moves against a high-speed gating roller 72 which is carried by a shaft 74 driven by a gating roller drive 114. Roller 72, which is also described in Winkler et al U.S. Pat. No. 4,420,153, is preferably made of cork so as to be able to frictionally direct a sheet in the desired path while at the same time having a low moment of inertia. Normally, drive 114 rotates gating roller 72 counterclockwise to direct a sheet emerging from the nip formed by rollers 64 and 52 along a lower feed path 96 to a subsequent processing location (not shown). Suitable feed members (not shown) driven at the speed of rollers 26, together with passive guide members (not shown), may be provided along feed path 96 if desired to assist the feeding of sheets 14.

Clockwise rotation of roller 72 directs the sheet alternatively along an upper path 98 between upper and lower guides 68 and 70 into the nip formed by a pair of upper accelerator rollers 76 carried by a shaft 78 and lower accelerator rollers 80 carried by a shaft 82 outboard of rollers 76. Rollers 76 and 80 direct the sheet traveling along path 98 into the upwardly extending portion 86 of an inverter pocket indicated generally by the reference numeral 84. Inverter pocket 84 also has a leading portion 88 which cooperates with guide 70. Upon striking the upper inner surface of upwardly extending portion 86, the sheet, now at location 100, moves downwardly, retracing a portion of the original path and emerging from the inverter pocket 86 between accelerator rollers 80 and a pair of rollers 92 carried by a shaft 94 to the right of shaft 82 as viewed in FIG. 1. A trailing portion 90 of pocket 84 cooperates with a trailing portion of guide 70 to direct the sheet between rollers 80 and 92. The exiting sheet then moves along a path 102 which rejoins the path 96 traversed by a sheet 14 that has not been inverted.

Because of the greater length of the path traveled by the inverted sheet, rollers 80, and hence rollers 76 and 92, are driven by an accelerator roller drive 112 at a peripheral velocity in excess of that of feed rollers 26 and their associated feed members. Preferably, shaft 82 is driven at such a velocity as to equalize the transit times of documents traversing the lower path 96 and the upper path comprising portions 98, 100 and 102.

In the disclosed sheet feeder, sheets are directed upwardly of gating roller 72 if they are facing in the wrong direction in the original stack 12. To determine whether such is the case, the sheets are examined by a face sensor 108 disposed between feed rollers 26 and drive roller 38 a they are temporarily halted at the entrance to the drive roller nip. A photodetector 106 receptive to a light source 104 on the upper side of the feed path at the entrance to the drive roller nip provides a signal to a control system 116 for regulating the direction of the gating-roller drive 114. Face sensor 108, which also provides an input signal to the control system 116, measures the total reflectance of the adjacent portion of the upper side of the sheet 14. Face sensor 108 may include a light source (not separately shown), similar to source 104, and a photodetector (not separately shown), similar to detector 106, responsive to reflected light from an adjacent sheet 14. Since the two sides of a bill of a given denomination differ in their patterns of reflectance, face sensor 108 effectively senses the orientation of the sheet.

Control system 116 may be of any suitable type known to the art, including in particular a microprocessor and associated circuits (not separately shown) for performing the necessary operations in a sequential manner. Other control circuits, including special-purpose digital circuits or even analog circuits, may also be used. In response to signals from sensors 106 and 108 indicating the presence of an incorrectly oriented sheet in the drive roller nip, control system 116 momentarily actuates gating roller 72 in a clockwise direction to direct the sheet to inverter pocket 84. Further details of the manner of operation of control system 116 may be found in my copending application, Ser. No. 271,915, filed Nov. 15, 1988, entitled "Facing Mechanism for Sheet Feeder", the specification of which is incorporated herein by reference.

It will be seen that I have accomplished the objects of my invention. My apparatus eliminates skew and, at the same time, momentarily stops sheets for examination or some other operation. It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Skew-correcting apparatus including in combination first and second sets of opposing feed rollers, said first set comprising a pair of first end rollers and a first center roller between said first end rollers, said second set comprising a pair of second end rollers and a second center roller between said second end rollers, said first center roller having a sheet-gripping portion of limited circumferential extent forming a nip with said second center roller, said first end rollers respectively engaging said second end rollers, means for coupling said second set of rollers for concomitant rotation, means for mounting said first end rollers for rotation relative to said first center roller, means for driving said first center roller, and means for retarding the rotation of rollers other than said first center roller, whereby said other rollers are normally stationary to align the leading edge of a sheet but are driven by said sheet-gripping portion of said first center roller to advance said sheet through said nip.

2. Apparatus as in claim 1 in which said sheet-gripping portion comprises a high-friction portion.

3. Apparatus as in claim 1 in which said sheet-gripping portion extends radially outwardly.

4. Apparatus as in claim 1 in which said sheet-gripping portion has a circumferential extent of about 90°.

5. Apparatus as in claim 1 including means for advancing a sheet toward said rollers of said sets synchronously with the rotation of said first center roller.

6. Apparatus as in claim 1 in which said retarding means comprises a drag brake.

* * * * *